US010889944B2

(12) United States Patent
Ellwein

(10) Patent No.: US 10,889,944 B2
(45) Date of Patent: Jan. 12, 2021

(54) CONTROL SYSTEM FOR CONTROLLING OPERATION OF COMPACTION SYSTEMS OF A PAVING MACHINE

(71) Applicant: Caterpillar Paving Products Inc., Brooklyn Park, MN (US)

(72) Inventor: Jacob Ryan Ellwein, Oak Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/114,297

(22) Filed: Aug. 28, 2018

(65) Prior Publication Data

US 2020/0071892 A1 Mar. 5, 2020

(51) Int. Cl.
*E01C 19/48* (2006.01)
*E01C 19/38* (2006.01)

(52) U.S. Cl.
CPC ..... *E01C 19/4853* (2013.01); *E01C 19/38* (2013.01); *E01C 19/4833* (2013.01)

(58) Field of Classification Search
CPC ..... E01C 19/38; E01C 19/4833
USPC ..... 404/84.1
See application file for complete search history.

(56) References Cited

U.S. PATENT DOCUMENTS 5,352,063 A * 10/1994 Allen ..... E01C 19/008 404/102
5,410,879 A * 5/1995 Houze ..... B06B 1/166 60/469
5,492,432 A * 2/1996 Eben ..... E01C 19/38 404/115
6,238,135 B1 5/2001 Roewer
6,717,379 B1 * 4/2004 Andersson ..... B06B 1/161 318/114
6,749,364 B1 6/2004 Baker et al.
7,168,890 B1 * 1/2007 Evarts ..... E02D 7/18 173/49
8,454,266 B2 6/2013 Buschmann et al.
8,721,218 B2 * 5/2014 Stenzel ..... B06B 1/161 404/133.05
8,807,866 B2 * 8/2014 Buschmann ..... E01C 19/407 404/74

(Continued)

FOREIGN PATENT DOCUMENTS

EP 1577443 9/2005

*Primary Examiner* — Gary S Hartmann
(74) *Attorney, Agent, or Firm* — Oblon, McClelland, Maier & Neustadt

(57) ABSTRACT

A control system for controlling operation of a vibratory system and a tamper system of a paving machine includes a first input device, a second input device, and a controller. The first input device is operable to provide a first speed signal for operating the vibratory system at a desired first rotational speed. The second input device is operable to provide a second speed signal for operating the tamper system at a desired second rotational speed. The controller receives the first speed signal and the second speed signal from corresponding ones of the first and second input devices and compares the desired first rotational speed and the desired second rotational speed. Based on the comparison, the controller determines if the desired first and second rotational speeds lie within a pre-defined range from each other. Based on the determination, the controller modulates at least one of the first and second speed signals.

20 Claims, 3 Drawing Sheets

(56) References Cited

U.S. PATENT DOCUMENTS

| | | | | |
|---|---|---|---|---|
| 9,045,871 | B2 | 6/2015 | Graham et al. | |
| 9,334,613 | B2 * | 5/2016 | Erdmann | B06B 1/161 |
| 9,790,648 | B2 * | 10/2017 | Buschmann | E01C 19/407 |
| 9,995,008 | B2 * | 6/2018 | Von Vett | E01C 19/288 |
| 2002/0168226 | A1 | 11/2002 | Feucht et al. | |
| 2008/0298893 | A1 * | 12/2008 | Stenzel | E01C 19/38 404/102 |
| 2010/0166499 | A1 * | 7/2010 | Stenzel | B06B 1/186 404/133.05 |
| 2018/0073204 | A1 | 3/2018 | Von Vett | |

* cited by examiner

CONTROL SYSTEM FOR CONTROLLING OPERATION OF COMPACTION SYSTEMS OF A PAVING MACHINE

TECHNICAL FIELD

The present disclosure relates to a paving machine. More particularly, the present disclosure relates to a control system and a method for controlling operation of compaction systems i.e., a vibratory system, a tamper system and/or a pressure bar system of the paving machine.

BACKGROUND

Typically, asphalt pavers having a screed are sometimes known to include a vibratory system for vibrating the screed in operation. For instance, U.S. Publication 2018/0073204 discloses a paving machine having a screed frame, a screed plate, and a vibratory system for vibrating the screed plate in operation. In many cases, such asphalt pavers may additionally include a tamper bar that would be driven by a tamper system. In such cases, the vibratory system and the tamper system would be operated independently of each other to vibrate the screed plate and the tamper bar respectively.

However, in some cases, while operating the asphalt paver, the tamper system and the vibratory system may operate such that their operational speeds could lie in close proximity to each other causing undesirable harmonic vibrations within the screed. These vibrations could, in turn, negatively impact a performance of the screed and/or cause operator discomfort.

Hence, there is a need for a control system that overcomes the aforementioned drawbacks by preventing the operational frequencies of the vibratory system and the tamper system from aligning with each other.

SUMMARY OF THE DISCLOSURE

In an aspect of this disclosure, a control system for controlling operation of a vibratory system and a tamper system of a paving machine includes a first input device, a second input device, and a controller. The first input device is operable to provide a first speed signal for operating the vibratory system at a desired first rotational speed. The second input device is operable to provide a second speed signal for operating the tamper system at a desired second rotational speed. The controller is configured to receive the first speed signal and the second speed signal from corresponding ones of the first and second input devices and compare the desired first rotational speed and the desired second rotational speed. Based on the comparison, the controller determines if the desired first and second rotational speeds lie within a pre-defined range from each other. Based on the determination, the controller modulates at least one of the first and second speed signals.

In another aspect of the present disclosure, a paving machine includes a frame, a vibratory system and a tamper system each mounted to the frame. Further, the paving machine also includes a first input device that is operable to provide a first speed signal for operating the vibratory system at a desired first rotational speed and a second input device operable to provide a second speed signal for operating the tamper system at a desired second rotational speed. Furthermore, the paving machine also includes a controller that is coupled in communication independently with each of the first and second input devices and the vibratory and tamper systems. The controller is configured to receive the first speed signal and the second speed signal from corresponding ones of the first and second input devices and compare the desired first rotational speed and the desired second rotational speed from corresponding ones of the first and second speed signals. Based on the comparison, the controller is configured to determine if the desired first and second rotational speeds lie within a pre-defined range from each other. Based on the determination, the controller is configured to modulate at least one of the first and second speed signals.

In yet another aspect of the present disclosure, a method is provided for controlling operation of a vibratory system and a tamper system associated with a paving machine. The method includes providing, by a first input device, a first speed signal for operating the vibratory system at a desired first rotational speed. The method also includes providing, by a second input device, a second speed signal for operating the tamper system at a desired second rotational speed. Further, the method includes receiving, by a controller, the first speed signal and the second speed signal from corresponding ones of the first and second input devices, and comparing, by means of the controller, the desired first rotational speed and the desired second rotational speed from corresponding ones of the first and second speed signals. Furthermore, the method also includes determining, by means of the controller, if the desired first and second rotational speeds lie within a pre-defined range from each other. Moreover, the method also includes modulating, by means of the controller, at least one of the first and second speed signals based on the determination.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
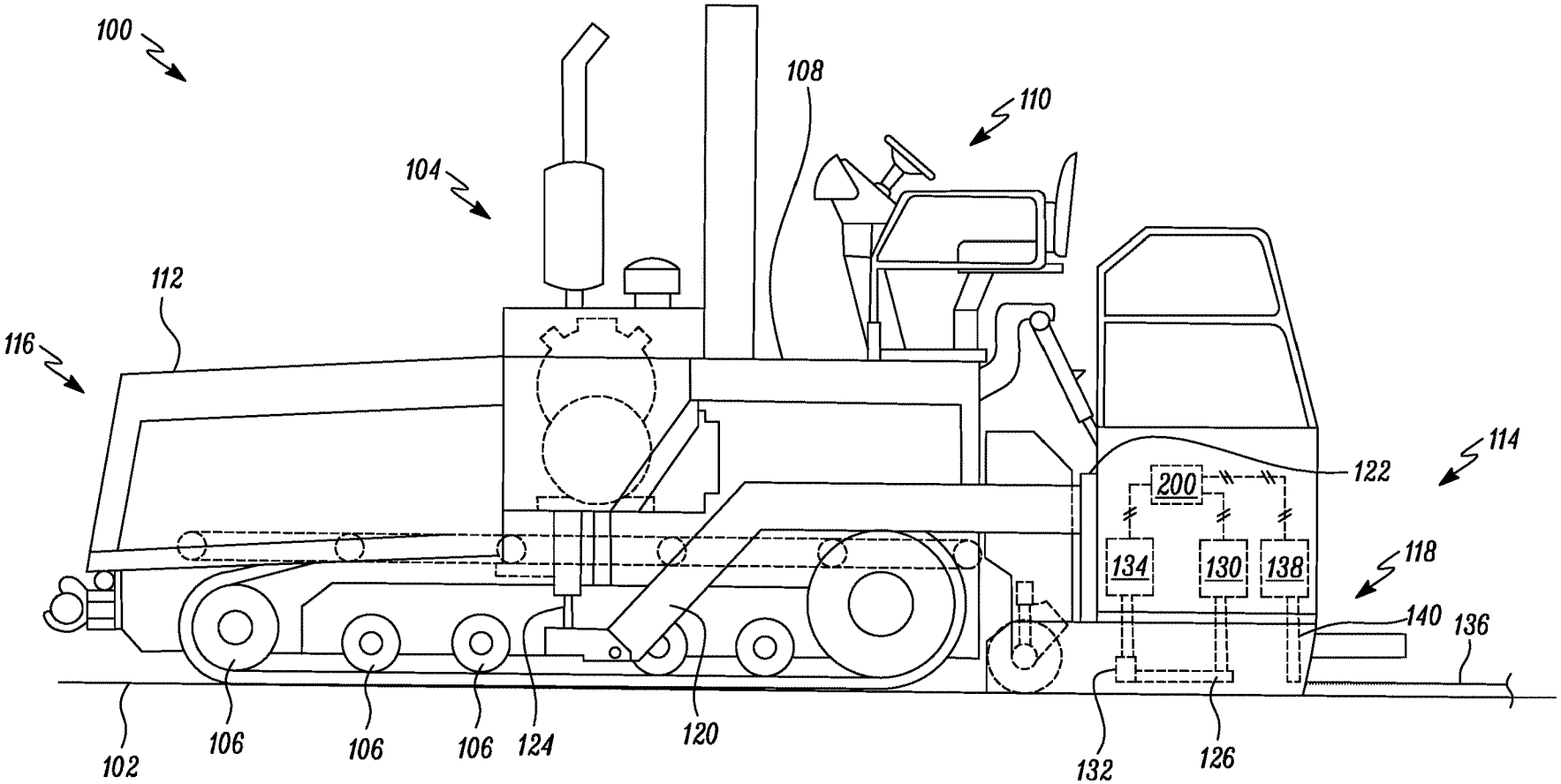
FIG. 1 is a side view of a paving machine having a vibratory system, a tamper system, and a control system in accordance with embodiments of the present disclosure.

FIG. 1 illustrates a side view of a paving machine 100. The paving machine 100 may be used for laying asphalt on a work surface 102, such as a roadway. Although the paving machine 100 is depicted as an asphalt paver, it will be appreciated that the paving machine 100 may be any other type of paving machine for laying any type of paving material to form a layer of the paving material on the work surface 102.

The paving machine 100 includes a tractor 104 configured to propel the paving machine 100 on the work surface 102. In the present embodiment, the tractor 104 is a wheel type tractor including a plurality of wheels 106 for providing traction between the tractor 104 and the work surface 102. In another embodiment, the tractor 104 may have tracks instead of the wheels 106 disclosed herein. These tracks, also known as crawlers, provide traction between the tractor 104 and the work surface 102. In yet another embodiment, the tractor 104 may also include a combination of both tracks and wheels for providing traction between the tractor 104 and the work surface 102.

The paving machine 100 also includes a power source (not shown) for propelling the tractor 104. The power source may be disposed in the tractor 104 and configured to drive the plurality of wheels 106 for propelling the tractor 104. The power source may be, but not limited to, an internal combustion engine, or a hybrid engine using batteries or another source of electrical power. The paving machine 100 may further include a generator (not shown) coupled to the power source. The generator may be configured to supply electric power to various electric components of the paving machine 100.

The tractor 104 includes a frame 108 configured to support various components of the paving machine 100 including, but not limited to, an operator station 110, a hopper 112, and a screed 118. As shown in the illustrated embodiment of FIG. 1, the operator station 110 is disposed adjacent to a rear end 114 of the tractor 104. The operator station 110 includes control levers and switches for an operator to control various parameters of a paving operation associated with the paving machine 100.

The hopper 112 is coupled to the frame 108 adjacent to a front end 116 of the tractor 104. The hopper 112 may be configured to receive the paving material from another machine, for example, a truck. The hopper 112 may include a conveyor (not shown) for transferring the paving material to the rear end 114 of the tractor 104. An auger (not shown) may also be installed on the rear end 114 of the tractor 104 to evenly distribute the paving material in front of the screed 118.

The screed 118 is disposed at the rear end 114 of the tractor 104. The screed 118 is configured to spread and compact the paving material deposited on the work surface 102. The screed 118 includes a screed frame 122, and a screed plate 126 mounted on the screed frame 122. The screed frame 122 is connected to the frame 108. In an embodiment, the screed frame 122 is movably coupled to the frame 108, via a pair of arms 120 (one of which arm 120 is shown in FIG. 1). The screed frame 122 is fastened to the pair of arms 120, which in turn is connected to the frame 108 via one or more actuators 124. The actuators 124 may be configured to raise, lower, shift, and/or tilt the screed frame 122 to adjust a location and/or an orientation of the screed frame 122 with respect to the work surface 102.

The screed plate 126 is configured to compact the paving material deposited on the work surface 102. Specifically, the screed plate 126 contacts with the paving material deposited on the work surface 102 to level the deposited paving material with respect to the work surface 102.

In an embodiment, the screed 118 may additionally include a plurality of extension plates (not shown) disposed laterally with respect to the screed plate 126. Each of the extension plates may be supported on an extension frame (not shown). The extension plates may be configured to contact the paving material deposited on the work surface 102 in association with the screed plate 126 for leveling the deposited paving material with respect to the work surface 102.

The screed 118 further includes a vibratory system 130 mounted on the screed frame 122. The vibratory system 130 is configured to vibrate the screed frame 122 and thus the screed plate 126. Specifically, the vibratory system 130 aids in compaction of the paving material deposited on the work surface 102 by providing a vibratory effort, i.e., vibration of the screed plate 126. Owing to the vibration of the screed frame 122, the screed plate 126 strikes the paving material after the paving material is deposited on the work surface 102 and thereby, compact the paving material, such as asphalt, to form an asphalt mat 136 on the work surface 102. In an embodiment, the asphalt mat 136 may be defined as a layer of paving material having a predefined thickness, a predefined width, and a predefined compactness deposited on the work surface 102.

The vibratory system 130 is mounted on the screed frame 122. In the present embodiment, the vibratory system 130 could be implemented with the help of a hydraulic motor that is connected to a vibratory pod (not shown). This vibratory pod could include mass (not shown) that is eccentrically mounted on a rotatable shaft supported by bearings. The vibratory system 130 includes an eccentric mass that rotates and is (not shown) coupled to the screed frame 122, thereby inducing oscillatory or vibrational forces to the screed frame 122, which in turn are imparted to the screed plate 126. As the screed plate 126 vibrates, the oscillatory or vibrational forces are imparted to the paving material deposited on the work surface 102 for forming the asphalt mat 136. In various embodiments, the vibratory system 130 may also be directly coupled to the screed plate 126 for vibrating the screed frame 122. Additionally, or alternatively, each of the screed plate 126 and the plurality of extension plates may be coupled to an individual vibratory system 130 to vibrate the screed frame 122.

Additionally, the paving machine 100 may include a tamper bar 132 for facilitating pre-compaction, or compaction of the paving material. The tamper bar 132 may include an elongated member with a flat surface (not shown) for engaging with the paving material. The tamper bar 132 may be movably coupled to the frame 108 and operatively driven by a tamper system 134 such that the tamper bar 132 is actuated in a generally vertical direction to strike a surface of the paving material for compaction thereof.

Figure 2:
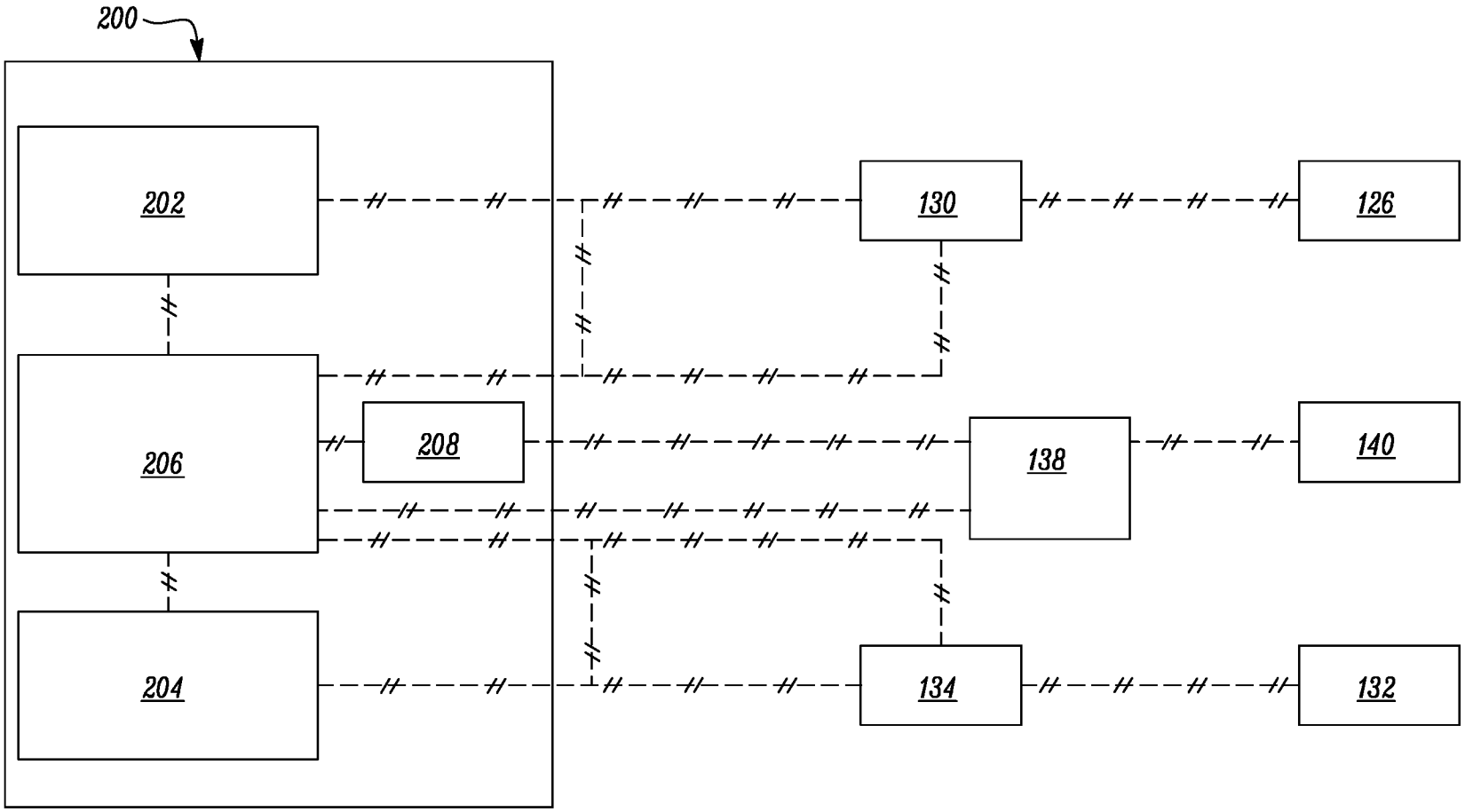
FIG. 2 is a block diagram of a control system for controlling an operation of the vibratory system and the tamper system respectively, in accordance with an embodiment of the present disclosure.

The paving machine 100 further includes a control system 200 for controlling operation of the vibratory system 130 and the tamper system 134. FIG. 2 illustrates a block diagram of the control system 200 for controlling operation of the vibratory system 130 and the tamper system 134 on the asphalt mat 136. As shown, the control system 200 includes a first input device 202, a second input device 204, and a controller 206. The first input device 202 is operable to provide a first speed signal for operating the vibratory system 130 at a desired first rotational speed. The second input device 204 is operable to provide a second speed signal for operating the tamper system 134 at a desired second rotational speed.

The controller 206 is coupled in communication independently with each of the first and second input devices 202, 204 and the vibratory and tamper systems 130, 134. The controller 206 is configured to receive the first speed signal and the second speed signal from corresponding ones of the first and second input devices 202, 204. The controller 206 is also configured to compare the desired first rotational speed and the desired second rotational speed with each other.

Based on the comparison, the controller 206 determines if the desired first and second rotational speeds lie within a pre-defined range from each other. In an embodiment, the pre-defined range may be ±100 revolutions per minute (RPM). In this embodiment, the controller 206 would be configured to determine if the desired first and second rotational speeds lie within 100 RPM of each other. In another embodiment, the pre-defined range may be ±50 RPM. In this embodiment, the controller 206 would be configured to determine if the desired first and second rotational speeds lie within 50 RPM of each other.

Based on the determination that the desired first and second rotational speeds lie within the pre-defined range from each other, the controller 206 modulates at least one of the first and second speed signals. In an embodiment herein, the controller 206 would be configured to modulate at least one of the first and second speed signals such that the desired first and second rotational speeds for operating corresponding ones of the vibratory and tamper systems 130, 134 are separated from one another by at least the pre-defined range i.e., by 100 RPM, or at least by 50 RPM, as disclosed earlier in the foregoing embodiments herein. It has been contemplated that by way of embodiments herein, the controller 206 would be configured to adjust a rotational speed of at least one of the vibratory and tamper systems 130, 134 by modulating at least one of the first and second speed signals so that harmonic oscillations are prevented from occurring in the paving machine 100 from subsequent operation of the vibratory and tamper systems 130, 134. In embodiments herein, although the pre-defined range is disclosed as ±50 RPM or ±100 RPM, it may be noted that these values are non-limiting of this disclosure. Rather, persons skilled in the art will appreciate that the pre-defined range may vary from one machine configuration to another and/or may depend on other specific requirements of an application.

In an embodiment herein, the first and second input devices 202, 204 disclosed herein are user-operable input devices. In such an embodiment, the first and second input devices 202, 204 would be physically, or remotely, operated by an operator of the paving machine 100. However, in another embodiment, the first and second input devices 202, 204 may also be operated autonomously, or at least semi-autonomously, by the controller 206, for providing the first speed signal and the second speed signal respectively. In such other embodiment, the controller 206 together with the first and second input devices 202, 204 would be configured to form part of a closed feedback loop, with or without additional devices such as, for example, speed sensors (not shown) that could be associated with the vibratory system 130 and the tamper system 134 respectively.

Additionally, in an embodiment as shown in FIG. 1, the paving machine 100 may include a pressure bar system 138 that is configured to operatively drive a pressure bar 140 for compacting the paved material adjacent the screed plate 126. Further, in this embodiment, the control system 200 could also include a third input device 208. The third input device 208 can be used to operably provide a third speed signal for operating the pressure bar system 138 at a desired third rotational speed.

In this embodiment, the controller 206 would be communicably coupled to the third input device as well. Also, the controller 206 would be configured to receive the third speed signal from the third input device 208, compare the desired first rotational speed with each of the first and second desired rotational speeds. Based on the comparison, the controller 206 would determine if the desired third rotational speed lies within a pre-defined range from each of the first and second rotational speeds. Further, based on the determination, the controller 206 would modulate at least one of the first, second and third speed signals.

Figure 3:
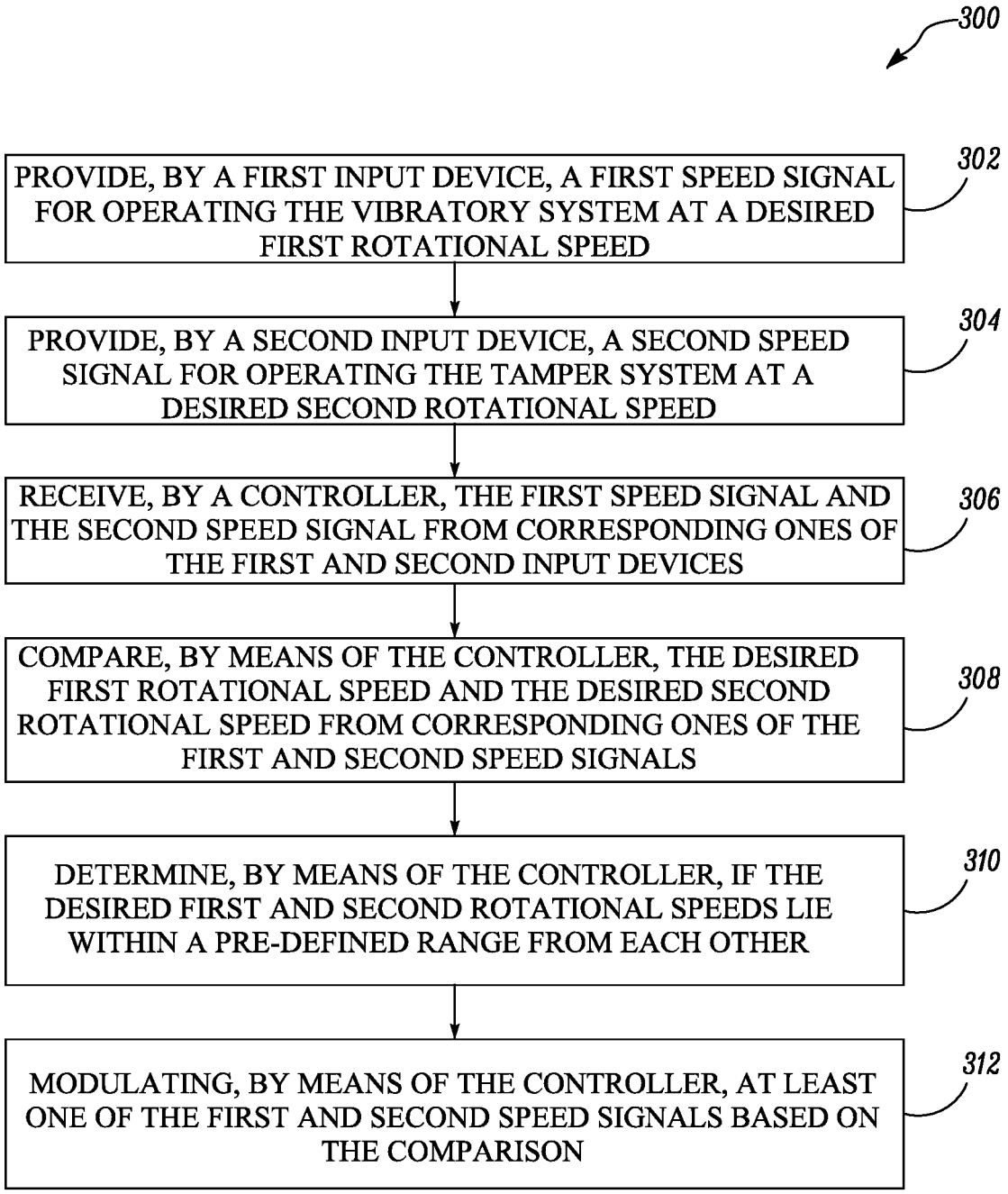
FIG. 3 is a flowchart of a method for controlling operation of a vibratory system and a tamper system associated with a paving machine, in accordance with an embodiment of the present disclosure.

FIG. 3 illustrates a flowchart of a method 300 for controlling operation of the vibratory system 130 and the tamper system 134. As shown at step 302, the method 300 includes providing, by the first input device 202, the first speed signal for operating the vibratory system 130 at the desired first rotational speed. At step 304, the method 300 includes providing, by the second input device 204, the second speed signal for operating the tamper system 134 at the desired second rotational speed.

Further, at step 306, the method 300 includes receiving, by the controller 206, the first speed signal and the second speed signal from corresponding ones of the first and second input devices 202, 204. At step 308, the method 300 includes comparing, by means of the controller 206, the desired first rotational speed and the desired second rotational speed from corresponding ones of the first and second speed signals.

Furthermore, at step 310, the method 300 includes determining, by means of the controller 206, if the desired first and second rotational speeds lie within a pre-defined range from each other. Moreover, at step 312, the method 300 includes modulating, by means of the controller 206, at least one of the first and second speed signals based on the determination.

As disclosed earlier in an embodiment herein, the controller 206 may modulate at least one of the first and second speed signals such that the desired first and second rotational speeds for operating corresponding ones of the vibratory and tamper systems 130, 134 are separated from one another by at least the pre-defined range. This way, harmonic oscillations may be prevented from occurring in the paving machine 100 from subsequent operation of the vibratory and tamper systems 130, 134.

Furthermore, as disclosed earlier in an embodiment herein, if the paving machine 100 includes the pressure bar system 138 and the pressure bar 140, the control system 200 would also be configured to include the third input device 208 that can be used to operably provide the third speed signal for operating the pressure bar system 138 at the desired third rotational speed. In such an embodiment, the method 300 would further include receiving, by the controller 206, the third speed signal from the third input device 208. The method 300 would also further include comparing, by means of the controller 206, the desired third rotational speed with each of the desired first rotational speed and the desired second rotational speed. Based on the comparison, the method 300 would also include determining, by means of the controller 206, if the desired third rotational speed lies within a pre-defined range from each of the first and second rotational speeds. Further, the method 300 would also include modulating, by means of the controller 206, at least one of the first, second and third speed signals based on the determination.

Various embodiments disclosed herein are to be taken in the illustrative and explanatory sense and should in no way be construed as limiting of the present disclosure. All joinder references (e.g., mounted, associated, coupled, connected and the like) are only used to aid the reader's understanding of the present disclosure, and may not create limitations, particularly as to the position, orientation, or use of the components disclosed herein. Therefore, joinder references, if any, are to be construed broadly. Moreover, such joinder references do not necessarily infer that two elements are directly connected to each other.

Additionally, all positional terms, such as, but not limited to, "fore", "rear", "downward", "first", "second" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element relative to, or over, another element.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional components, such features may be omitted from the scope of the present disclosure without departing from the spirit of the present disclosure as defined in the appended claims.

INDUSTRIAL APPLICABILITY

The present disclosure has applicability for use and implementation in preventing harmonic oscillations from occurring in a paving machine when a vibratory system and a tamper system of the paving machine are used. The need for adequate pre-compaction when paving may urge operators to use the vibratory and tamper systems in tandem. However, if the speeds of operation for the vibratory and tamper systems, when used together, lie close to each other, then harmonic oscillations may occur, and a quality of the paving job can consequently deteriorate. Also, if frequencies from operation of the vibratory and tamper systems at such speeds resonate with the natural frequency of the overall machine, then a stability of the machine would also be negatively impacted further driving down the quality of the paving job.

With use of embodiments disclosed herein, manufacturers of machines can implement the control system for preventing the speeds, and hence, the frequencies from operation of the vibratory and tamper systems from lying within a pre-defined range of each other. This way, harmonic oscillations may be prevented from occurring, and a stability of the machine can be maintained. Consequently, a quality of the paving job can be maintained at an optimum level across a range of operational speeds associated with each of the vibratory and tamper systems. With such implementation, it is also envisioned that manual intervention that was previously required by an operator of the machine to ensure that harmonic oscillations do not occur would now be obviated, thus causing the operator of the machine less fatigue as compared to previously known operating techniques.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. A control system for controlling operation of a vibratory system and a tamper system of a paving machine, the control system comprising:

a first input device operable to provide a first operating signal for operating the vibratory system according to a desired first operating speed;

a second input device operable to provide a second operating signal for operating the tamper system according to a desired second operation speed; and a controller coupled in communication independently with each of the first and second input devices and the vibratory and tamper systems, the controller configured to:

receive the first operating signal and the second operating signal from corresponding ones of the first and second input devices, compare the desired first operating speed and the desired second operating speed associated with the first operating signal and the second operating signal, respectively, determine, based on the comparison, whether the desired first and second operating speeds lie within a pre-defined range from each other, and modulate, when it is determined that the desired first and second operating speeds lie within the pre-defined range from each other, at least one of the first and second operating signals to operate the vibratory system according to a first operating speed and to operate the tamper system according to a second operating speed separated from one another by at least the pre-defined range such that undesirable harmonic oscillations are prevented in at least a screed of the vibratory system.

2. The control system of claim 1, wherein the controller is configured to adjust the second operating speed of the tamper systems by modulating the second operating signal so that the undesirable harmonic oscillations are prevented from occurring in the paving machine from subsequent operation of the vibratory and tamper systems.

3. The control system of claim 1, wherein the operating speed of the vibratory system is a rotation speed, and the controller is configured to adjust the rotational speed of the vibratory system by modulating the first operating signal so that the undesirable harmonic oscillations are prevented from occurring in the paving machine from subsequent operation of the vibratory and tamper systems.

4. The control system of claim 1 further comprising a third input device operable to provide a third operating signal for operating a pressure bar system of the paving machine according to a desired third operating speed.

5. The control system of claim 4, wherein the controller is communicably coupled to the third input device, the controller configured to:

receive the third operating signal from the third input device, compare the desired third operating speed with each of the desired first operating speed and the desired second operating speed, determine, based on the comparison, whether the desired third operating speed lies within a second pre-defined range from each of the first and second operating speeds, and modulate, when it is determined that the desired third operating speed lies within the second pre-defined range from each of the first and second operating speeds, at least one of the first, second, and third operating signals to operate the vibratory system according to the first operating speed, to operate the tamper system according to the second operating speed, and to operate the pressure bar system according to a third operating speed separated from one another by at least the second pre-defined range such that undesirable harmonic oscillations are prevented in at least the screed of the vibratory system.

6. The control system of claim 1, wherein the first and second input devices are user-operable input devices.

7. The control system of claim 1, wherein the first and second input devices are operated autonomously by the controller for providing the first operating signal and the second operating signal, respectively.

8. A paving machine comprising:

a frame;

a vibratory system mounted to the frame;

a tamper system mounted to the frame;

a first input device operable to provide a first operating signal for operating the vibratory system according to a desired first operating speed;

a second input device operable to provide a second operating signal for operating the tamper system according to a desired second operating speed; and a controller coupled in communication independently with each of the first and second input devices and the vibratory and tamper systems, the controller configured to:

receive the first operating signal and the second operating signal from corresponding ones of the first and second input devices, compare the desired first operating speed and the desired second operating speed associated with the first operating signal and the second operating signal, respectively, determine, based on the comparison, whether the desired first and second operating speeds lie within a pre-defined range from each other, and modulate, when it is determined that the desired first and second operating speeds lie within the pre-defined range from each other, at least one of the first and second operating signals to operate the vibratory system according to a first operating speed and to operate the tamper system according to a second operating speed separated from one another by at least the pre-defined range such that undesirable harmonic oscillations are prevented in at least a screed of the vibratory system.

9. The paving machine of claim 8, wherein the controller is configured to adjust the second operating speed of the tamper systems by modulating the second operating signal so that the undesirable harmonic oscillations are prevented from occurring in the paving machine from subsequent operation of the vibratory and tamper systems.

10. The paving machine of claim 8, wherein the operating speed of the vibratory system is a rotation speed, and the controller is configured to adjust the rotational speed of the vibratory system by modulating the first operating signal so that the undesirable harmonic oscillations are prevented from occurring in the paving machine from subsequent operation of the vibratory and tamper systems.

11. The paving machine of claim 8 further comprising:

a pressure bar system; and a third input device operable to provide a third operating signal for operating the pressure bar system at a desired third operating speed.

12. The paving machine of claim 11, wherein the controller is communicably coupled to the third input device, the controller being configured to:

receive the third operating signal from the third input device, compare the desired third operating speed with each of the desired first operating speed and the desired second operating speed, determine, based on the comparison, whether the desired third operating speed signal lies within a second pre-defined range from each of the first and second operating speeds, and modulate, when it is determined that the desired third operating speed lies within the second pre-defined range from each of the first and second operating speeds, at least one of the first, second, and third operating signals to operate the vibratory system according to the first operating speed, to operate the tamper system according to the second operating speed, and to operate the pressure bar system according to a third operating speed separated from one another by at least the second pre-defined range such that undesirable harmonic oscillations are prevented in at least the screed of the vibratory system.

13. The paving machine of claim 8, wherein the first and second input devices are user-operable input devices.

14. The paving machine of claim 8, wherein the first and second input devices are operated autonomously by the controller for providing the first operating signal and the second operating signal, respectively.

15. A method for controlling operation of a vibratory system and a tamper system associated with a paving machine, the method comprising:

providing, by a first input device, a first operating signal for operating the vibratory system according to a desired first operating speed;

providing, by a second input device, a second operating signal for operating the tamper system according to a desired second operating speed; and receiving, using a controller, the first operating signal and the second operating signal from the first and second input devices, respectively, comparing, using the controller, the desired first operating speed and the desired second operating speed associated with the first operating signal and the second operating signal, respectively, determining, using the controller, whether the desired first and second operating speeds lie within a pre-defined range from each other, and modulating, using the controller, at least one of the first and second operating signals when it is determined that the desired first and second operating speeds lie within the pre-defined range from each other to operate the vibratory system according to a first operating speed and to operate the tamper system according to a second operating speed separated from one another by at least the pre-defined range such that an undesirable harmonic oscillation is prevented in at least a screed of the vibratory system.

16. The method of claim 15 further comprising adjusting, using the controller, the second operating speed of the tamper systems by modulating the second operating signal so that the undesirable harmonic oscillation is prevented from occurring in the paving machine from subsequent operation of the vibratory and tamper systems.

17. The method of claim 15, wherein the first operating speed of the vibratory system is a rotation speed, and the controller is configured to adjust the rotational speed of the vibratory system by modulating the first operating signal so that the undesirable harmonic oscillation is prevented from occurring in the paving machine from subsequent operation of the vibratory and tamper systems.

18. The method of claim 15 further comprising:

providing, by a third input device, a third operating signal for operating a pressure bar system of the paving machine at a desired third operating speed;

receiving, using the controller, the third operating signal from the third input device;

comparing, using the controller, the desired third vibration-related operation characteristic with each of the desired first rotational speed and the desired second rotational speed, determining, using the controller, whether the desired third operating speed lies within a second pre-defined range from each of the first and second operating speeds, and modulating, using the controller, at least one of the first, second, and third operating signals when it is determined that the desired third operating speed lies within the second pre-defined range from each of the first and second operating speeds to operate the vibratory system according to the first operating speed, to operate the tamper system according to the second operating speed, and to operate the pressure bar system according to a third operating speed separated from one another by at least the second pre-defined range such that undesirable harmonic oscillation is prevented in at least the screed of the vibratory system.

19. The method of claim 15, wherein the first and second input devices are user-operable input devices.

20. The method of claim 15, wherein the first and second input devices are operated autonomously by the controller for providing the first operating signal and the second operating signal, respectively.

* * * * *